US008365367B2

(12) United States Patent
Matsumoto

(10) Patent No.: US 8,365,367 B2
(45) Date of Patent: Feb. 5, 2013

(54) SLIDE FASTENER

(75) Inventor: Masaki Matsumoto, Mie (JP)

(73) Assignee: Masaki Matsumoto, Kuwana-shi (JP)

( * ) Notice: Subject to any disclaimer, the term of this patent is extended or adjusted under 35 U.S.C. 154(b) by 0 days.

(21) Appl. No.: 13/342,279

(22) Filed: Jan. 3, 2012

(65) Prior Publication Data

US 2012/0096685 A1 Apr. 26, 2012

Related U.S. Application Data

(63) Continuation of application No. PCT/JP2010/004281, filed on Jun. 29, 2010.

(30) Foreign Application Priority Data

Jul. 9, 2009 (JP) ..... 2009-162280

(51) Int. Cl.

| | |
|---|---|
| ***A44B 19/02*** | (2006.01) |
| ***A44B 19/16*** | (2006.01) |
| ***A44B 19/18*** | (2006.01) |
| ***A44B 19/26*** | (2006.01) |

(52) U.S. Cl. ..... 24/382; 24/383; 24/415; 24/427; 24/428

(58) Field of Classification Search ..... 24/382, 24/383, 399, 401, 403, 405, 409, 410, 415, 24/427, 428, 585.1

See application file for complete search history.

(56) References Cited

U.S. PATENT DOCUMENTS

| | | | | |
|---|---|---|---|---|
| 2,229,216 | A * | 1/1941 | Marinsky | 24/382 |
| 2,483,057 | A | 9/1949 | Levering | |
| 4,112,552 | A * | 9/1978 | Lee | 24/382 |
| 4,485,534 | A * | 12/1984 | Pilie et al. | 24/384 |
| 4,757,577 | A * | 7/1988 | Freeman | 24/382 |
| 6,742,225 | B2 * | 6/2004 | Marty et al. | 24/382 |
| 6,981,282 | B2 * | 1/2006 | Marty et al. | 2/69 |
| 6,993,792 | B2 * | 2/2006 | Marty et al. | 2/69 |
| 7,024,701 | B2 * | 4/2006 | Marty et al. | 2/96 |
| 2004/0055117 | A1 * | 3/2004 | Marty et al. | 24/382 |

FOREIGN PATENT DOCUMENTS

| | | | |
|---|---|---|---|
| JP | 53-025142 | A | 3/1978 |
| JP | 55-045445 | A | 3/1980 |
| JP | 61-136917 | U | 8/1986 |
| JP | 63-174603 | U | 11/1988 |
| JP | 2004-008662 | A | 1/2004 |
| JP | 4512165 | B1 | 7/2010 |

OTHER PUBLICATIONS

International Search Report of PCT/JP2010/004281, mailing date Oct. 12, 2010.

* cited by examiner

*Primary Examiner* — Robert J Sandy
(74) *Attorney, Agent, or Firm* — Westerman, Hattori, Daniels & Adrian, LLP

(57) ABSTRACT

The slide fastener includes elements, and a slider, the slide fastener including a horizontal functional section and a vertical functional section. The horizontal functional section includes element heads which are meshed with and unmeshed from each other, and horizontal fastener tapes which are opened and closed in a horizontal direction. The vertical functional section and includes upper element legs which are formed by extending the elements upwards and bending the extended upper portions into a hook-like shape, upper holding portions formed by distal ends of the upper element legs, an upper vertical fastener tape which is engageable in the upper holding portions, lower element legs which are formed by extending the elements downwards and bending the extended lower portions into a hook-like shape, lower holding portions formed by distal ends of the lower element legs, and a lower vertical fastener tape which is engageable in the lower holding portions.

1 Claim, 11 Drawing Sheets

SLIDE FASTENER

TECHNICAL FIELD

The present invention relates to creation of a fastener element having a specific shape, and to a slide fastener with a function of dividing one space into four spaces orthogonal to one another.

BACKGROUND ART

In many existing slide fasteners, elements are attached in a line to each of edges of a pair of tapes. By moving a slider between left and right elements in pair, which constitute one set of elements, the left and right elements are successively meshed with each other for closing of the slide fastener in a freely openable manner. With that structure, the slide fastener operates such that when the slider is pulled and moved from an open state of the fastener in a direction toward the side where the elements are unmeshed, the elements are meshed with each other up to the position to which the slider has been moved, and such that when the slider is pulled and moved from a closed state of the fastener in a direction toward the side where the elements are meshed, the elements are unmeshed from each other up to the position to which the slider has been moved. The slide fasteners are primarily attached to openings of clothes, bags, etc. for helping people to more easily put on and off the clothes and to take things into and out of the bags.

SUMMARY OF INVENTION

The known slide fasteners have been used just in a way of dividing one space into two spaces to be adapted for the case of putting on and off the clothes and the case of opening and closing the bags, as described above. A slide fastener is provided with a function of dividing one space into four spaces orthogonal to one another, by creating a fastener element having a specific shape.

A slide fastener according to a first aspect comprises elements, which are arranged in a line along each of oppositely-positioned edges of opening/closing ends of horizontal fastener tapes, and a slider, the slide fastener including a horizontal functional section for dividing one space into two spaces and a vertical functional section for dividing each of the two spaces, divided by the horizontal functional section, into two spaces with one operation by sliding the slider along the elements, wherein the horizontal functional section includes element heads which are meshed with and unmeshed from each other with the sliding of the slider along the elements, and horizontal fastener tapes which are opened and closed in a horizontal direction corresponding to meshing and unmeshing of the element heads, and wherein the vertical functional section is extended upwards and downwards in a vertical direction perpendicularly to the horizontal functional section and includes upper element legs which are formed by extending portions of the elements upwards in the vertical direction and by bending the extended upper portions into a hook-like shape, upper holding portions formed by distal ends of the upper element legs coming close to and moving away from each other in conjunction with the meshing and the unmeshing of the element heads, an upper vertical fastener tape which is engageable in the upper holding portions for selective opening/closing in the vertical direction on an upper side, lower element legs which are formed by extending portions of the elements downwards in the vertical direction and by bending the extended lower portions into a hook-like shape, lower holding portions formed by distal ends of the lower element legs coming close to and moving away from each other in conjunction with the meshing and the unmeshing of the element heads, and a lower vertical fastener tape which is engageable in the lower holding portions for selective opening/closing in the vertical direction on a lower side.

According to the slide fastener according to the first aspect, the slide fastener comprises elements, which are arranged in a line along each of oppositely-positioned edges of opening/closing ends of horizontal fastener tapes, and a slider, the slide fastener including a horizontal functional section for dividing one space into two spaces and a vertical functional section for dividing each of the two spaces, divided by the horizontal functional section, into two spaces with one operation by sliding the slider along the elements, wherein the horizontal functional section includes element heads which are meshed with and unmeshed from each other with the sliding of the slider along the elements, and horizontal fastener tapes which are opened and closed in a horizontal direction corresponding to meshing and unmeshing of the element heads, and wherein the vertical functional section is extended upwards and downwards in a vertical direction perpendicularly to the horizontal functional section and includes upper element legs which are formed by extending portions of the elements upwards in the vertical direction and by bending the extended upper portions into a hook-like shape, upper holding portions formed by distal ends of the upper element legs coming close to and moving away from each other in conjunction with the meshing and the unmeshing of the element heads, an upper vertical fastener tape which is engageable in the upper holding portions for selective opening/closing in the vertical direction on an upper side, lower element legs which are formed by extending portions of the elements downwards in the vertical direction and by bending the extended lower portions into a hook-like shape, lower holding portions formed by distal ends of the lower element legs coming close to and moving away from each other in conjunction with the meshing and the unmeshing of the element heads, and a lower vertical fastener tape which is engageable in the lower holding portions for selective opening/closing in the vertical direction on a lower side. With that structure, it is possible to provide the slide fastener with the function enabling the slide fastener to be used in way of dividing one space into four spaces, which are orthogonal to one another, with one operation using one slider.

DETAILED DESCRIPTION OF THE INVENTION

Figure 1:
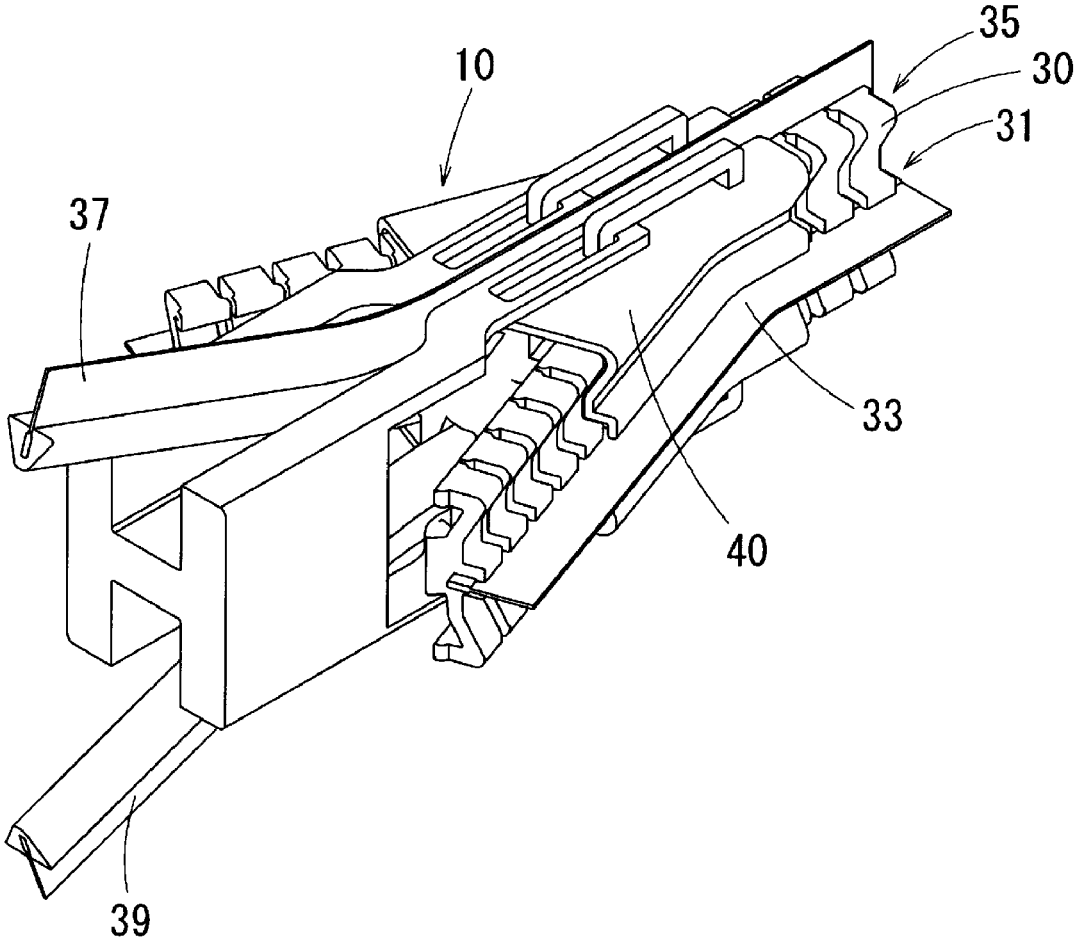
FIG. 1 is a perspective view illustrating an embodiment of a slide fastener.

An embodiment of a slide fastener according to the present invention will be described in detail below with reference to FIGS. 1 to 6. As illustrated in FIG. 1, a slide fastener 10 is constituted by elements 30, which are arranged in a line along each of oppositely-positioned edges of opening/closing ends of horizontal fastener tapes 33, and a slider 40. The slide fastener 1 includes a horizontal functional section 31 for dividing one space into two spaces and a vertical functional section 35 for further dividing each of the two spaces, divided by the horizontal functional section 31, into two spaces, both the divisions being performed with one operation using one slider, i.e., just by sliding one slider 40 along the elements 30 arranged on the left and right sides in pair.

Figure 2:
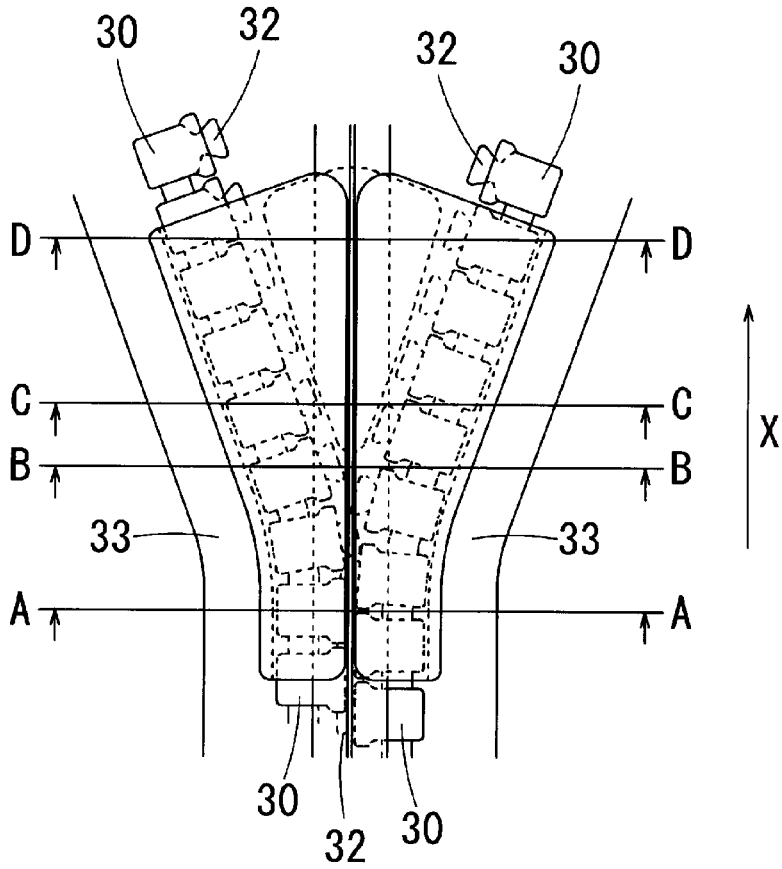
FIG. 2 is a partial plan view of the slide fastener illustrated in FIG. 1.
Figure 3:
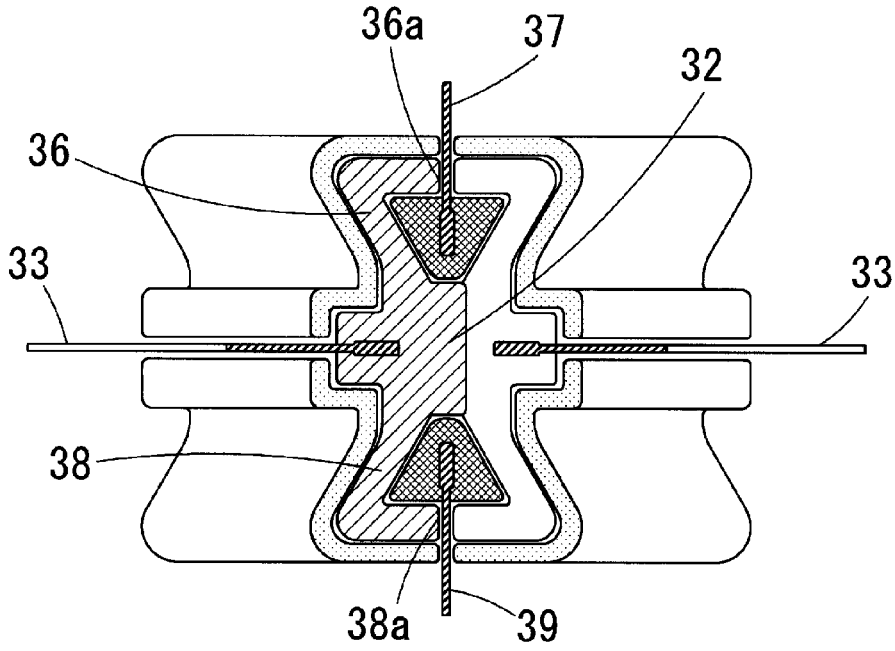
FIG. 3 is a sectional view taken along a line A-A in FIG. 2 as viewed in the direction denoted by the arrows.
Figure 4:
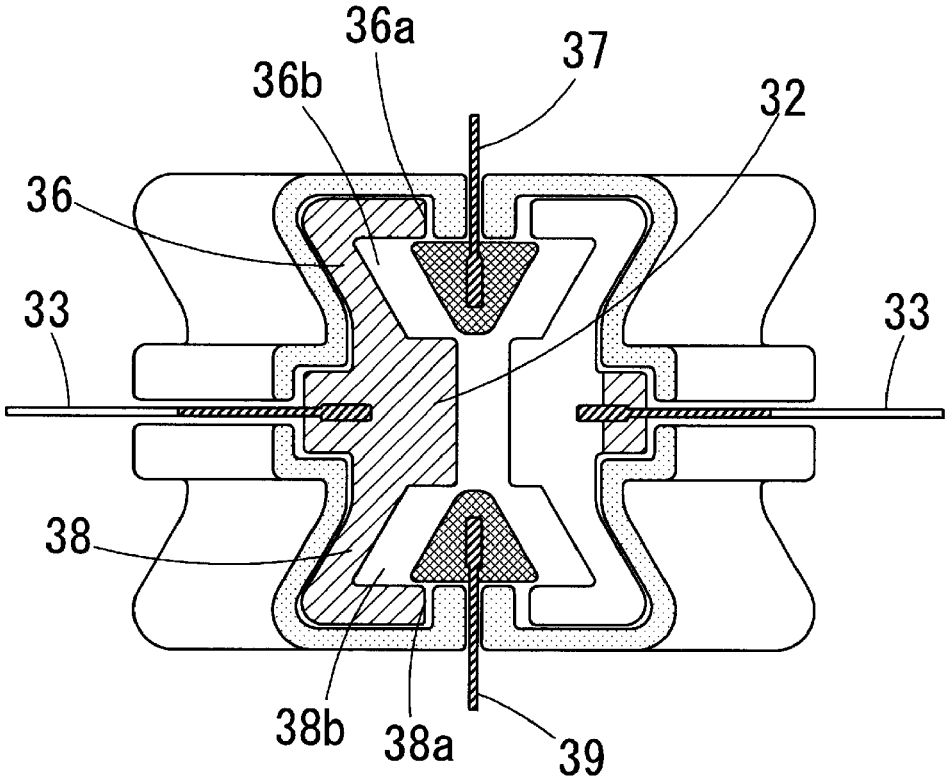
FIG. 4 is a sectional view taken along a line B-B in FIG. 2 as viewed in the direction denoted by the arrows.
Figure 5:
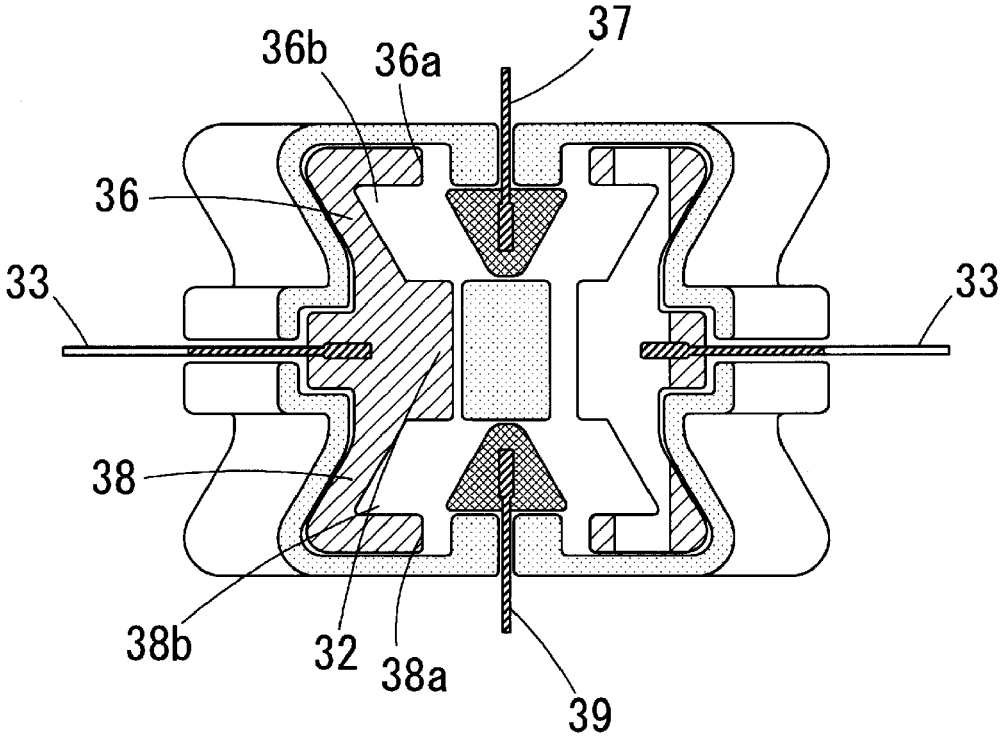
FIG. 5 is a sectional view taken along a line C-C in FIG. 2 as viewed in the direction denoted by the arrows.
Figure 6:
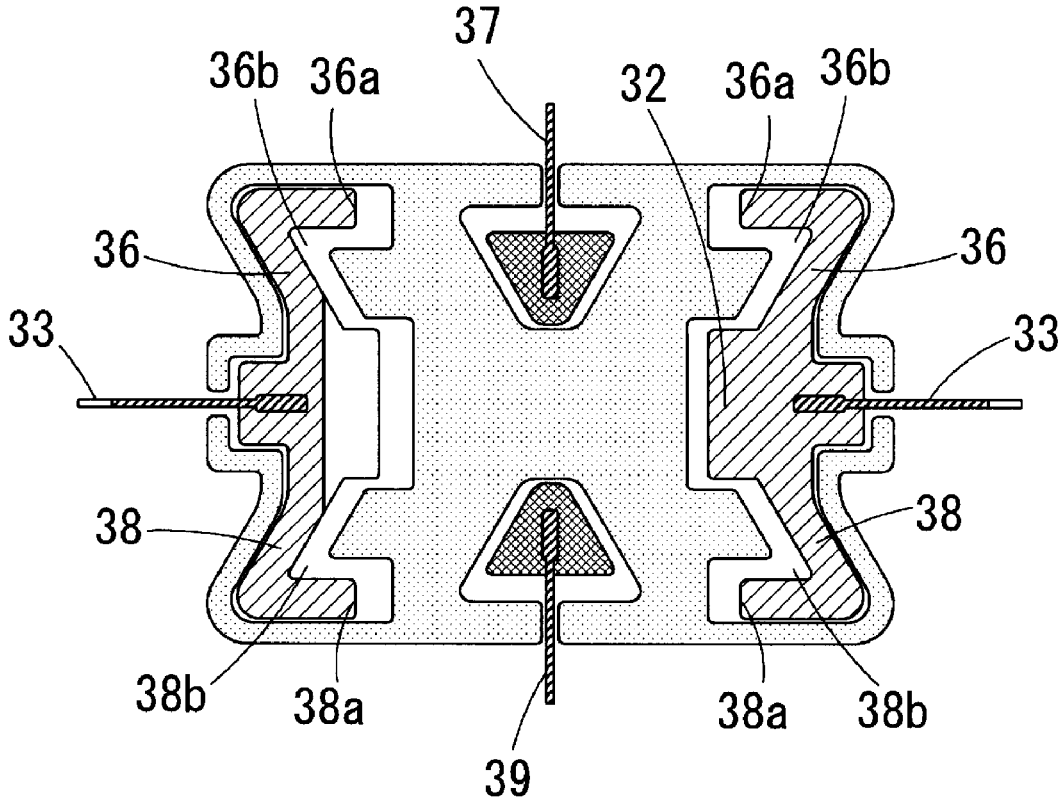
FIG. 6 is a sectional view taken along a line D-D in FIG. 2 as viewed in the direction denoted by the arrows.

As illustrated in FIG. 2, when the slider 40 is slid along the elements 30 in the direction denoted by an arrow X, the horizontal functional section 31 operates as follows. Heads 32 of the elements 30 are unmeshed from each other at a position (corresponding to FIG. 6) denoted by a line D-D, but they are moved to gradually come closer to each other as represented by a position (corresponding to FIG. 5) denoted by a line C-C and a position (corresponding to FIG. 4) denoted by a line B-B. Finally, the element heads 32 are meshed with each other at a position (corresponding to FIG. 3) denoted by a line A-A, whereby the horizontal fastener tapes 33 are closed in the horizontal direction.

The vertical functional section 35 is extended upwards and downwards in the vertical direction perpendicularly to the horizontal functional section 31. Upper element legs 36 extending upwards in the vertical direction and lower element legs 38 extending downwards in the vertical direction are bent into a hook-like shape. Distal ends 36*a* of the upper element legs 36 and distal ends 38*a* of the lower element legs 38 are positioned away from each other at the position (corresponding to FIG. 6) denoted by the line D-D. In conjunction with the operation of the heads 32 of the elements 30, however, the distal ends 36*a* of the element upper legs 36 and the distal ends 38*a* of the element lower legs 38 are moved to gradually come closer to each other on the upper and lower sides, respectively, as represented by the position (corresponding to FIG. 5) denoted by the line C-C and the position (corresponding to FIG. 4) denoted by the line B-B. Finally, the distal ends 36*a* and the distal ends 38*a* are positioned close to each other to respectively form an upper holding portion 36*b* and a lower holding portion 38*b* at the position (corresponding to FIG. 3) denoted by the line A-A. Thus, an upper vertical fastener-tape fixed portion 37*a* of the upper vertical fastener tape 37 and a lower vertical fastener-tape fixed portion 39*a* of the lower vertical fastener tape 39 are engaged respectively in the upper holding portions 36*b* and the lower holding portions 38*b*, whereby the upper and lower vertical fastener tapes are closed in the vertical direction.

Details of the element 30 and the slider 40, both constituting the slide fastener, will be described below with reference to FIGS. 7 to 14.

Figure 7:
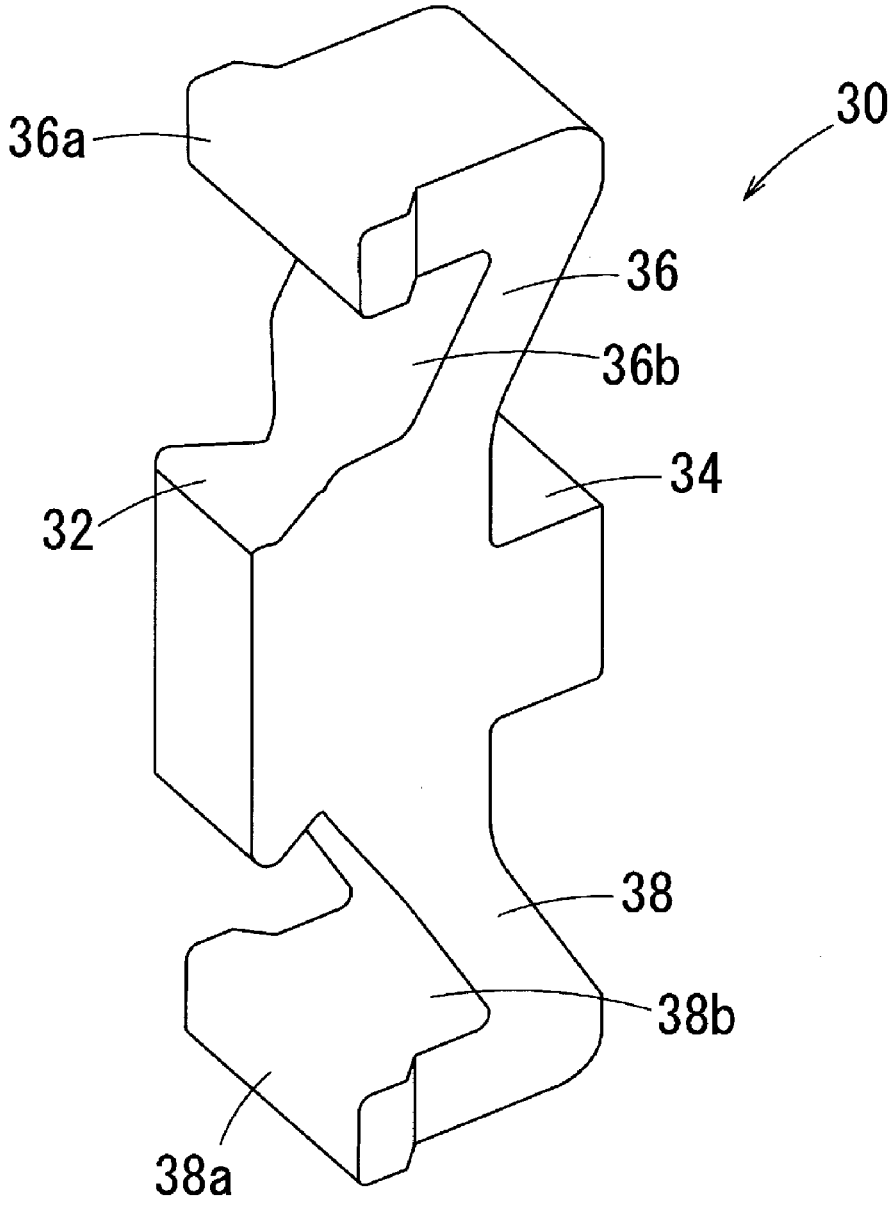
FIG. 7 is a perspective view illustrating an embodiment of an element constituting the slide fastener.

As illustrated in FIG. 7, the element 30 has a specific shape including the element head 32 which comes into and out of mesh with the sliding of the slider, the horizontal fastener tape 33 which is opened and closed in the horizontal direction corresponding to meshing and unmeshing of the element heads 32, the upper element leg 36 and the lower element leg 38 which are formed respectively by extending portions of the element upwards and downwards vertically to the horizontal direction and by bending the extended upper and lower portions into a hook-like shape, and one half of the upper holding portion 36*b* and one half of the lower holding portion 38*b*, which are formed respectively when the distal ends 36*a* of the upper element legs 36 and the distal ends 38*a* of the lower element legs 38 come close to and move away from each other in conjunction with the meshing and the unmeshing of the element heads 32.

Figure 8:
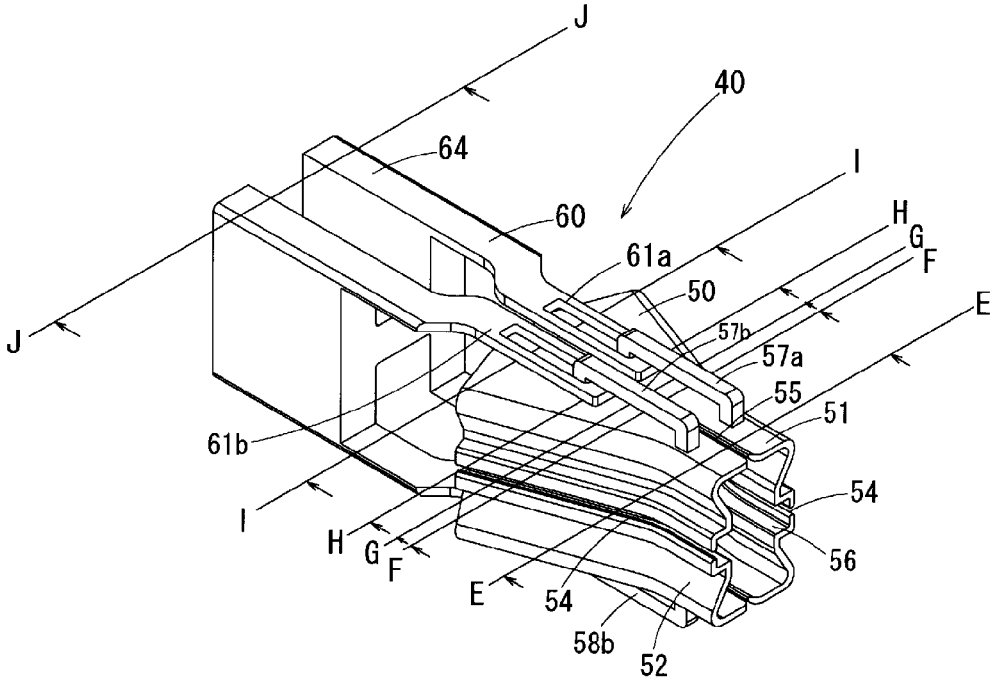
FIG. 8 is a perspective view illustrating an embodiment of a slider constituting the slide fastener.
Figure 9:
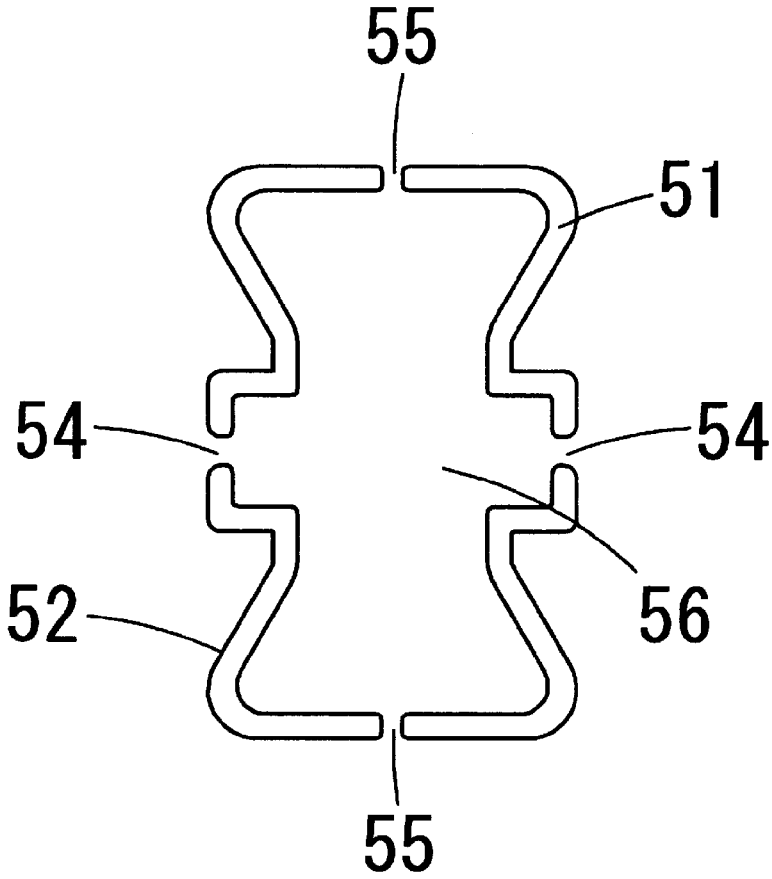
FIG. 9 is a sectional view taken along a line E-E in FIG. 8 as viewed in the direction denoted by the arrows.
Figure 10:
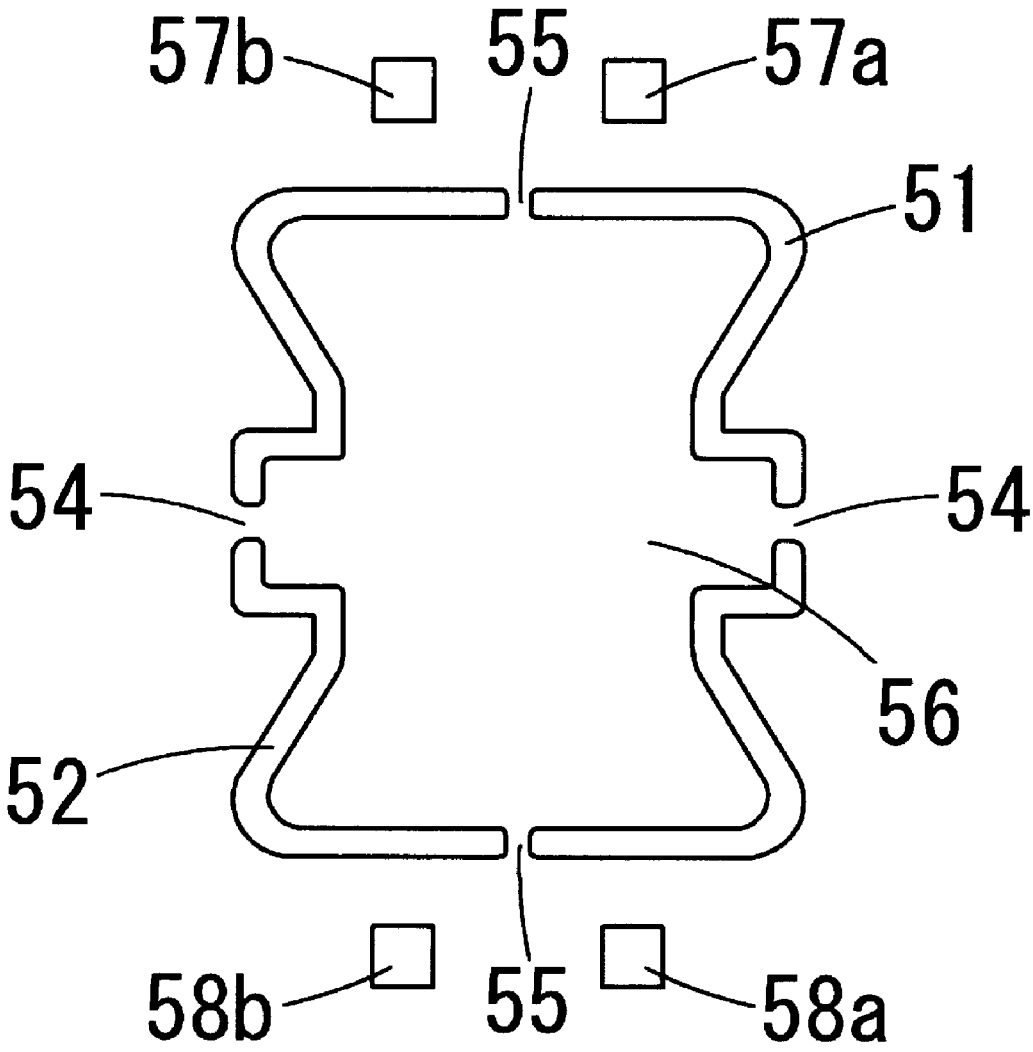
FIG. 10 is a sectional view taken along a line F-F in FIG. 8 as viewed in the direction denoted by the arrows.
Figure 11:
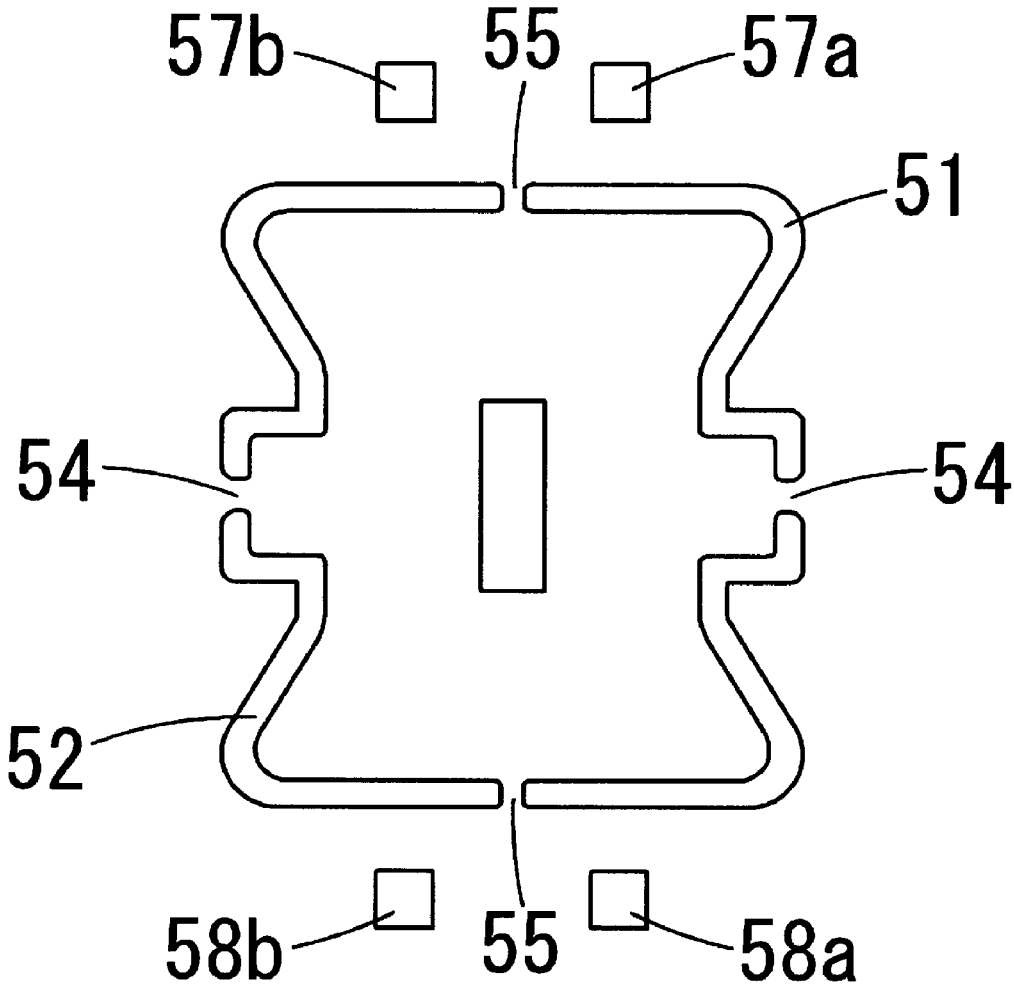
FIG. 11 is a sectional view taken along a line G-G in FIG. 8 as viewed in the direction denoted by the arrows.
Figure 12:
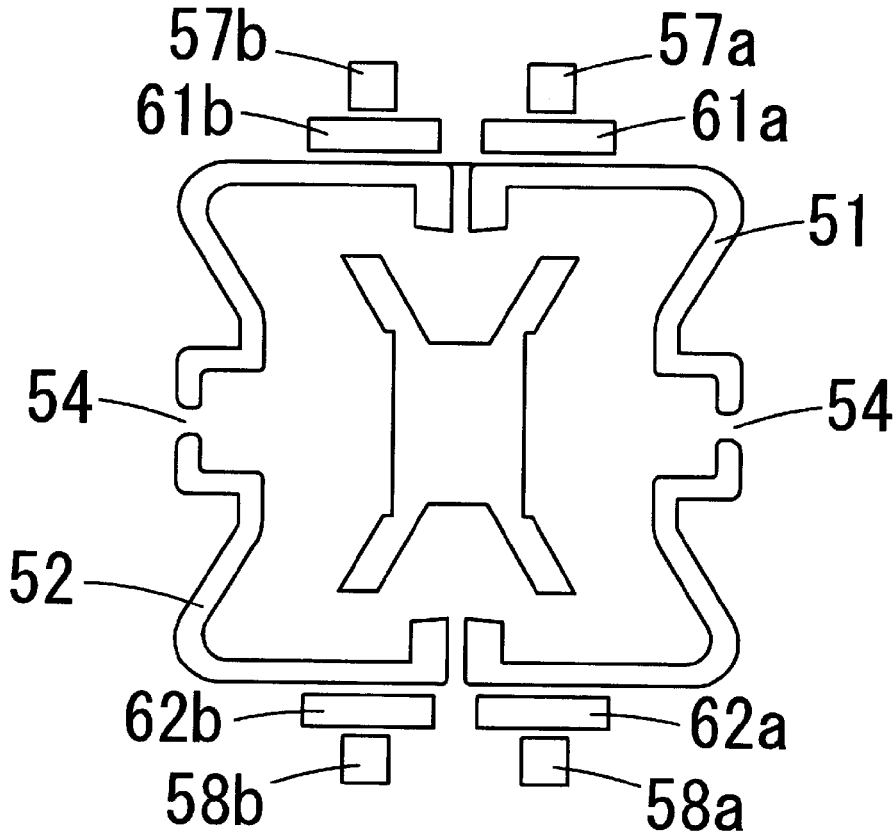
FIG. 12 is a sectional view taken along a line H-H in FIG. 8 as viewed in the direction denoted by the arrows.
Figure 13:
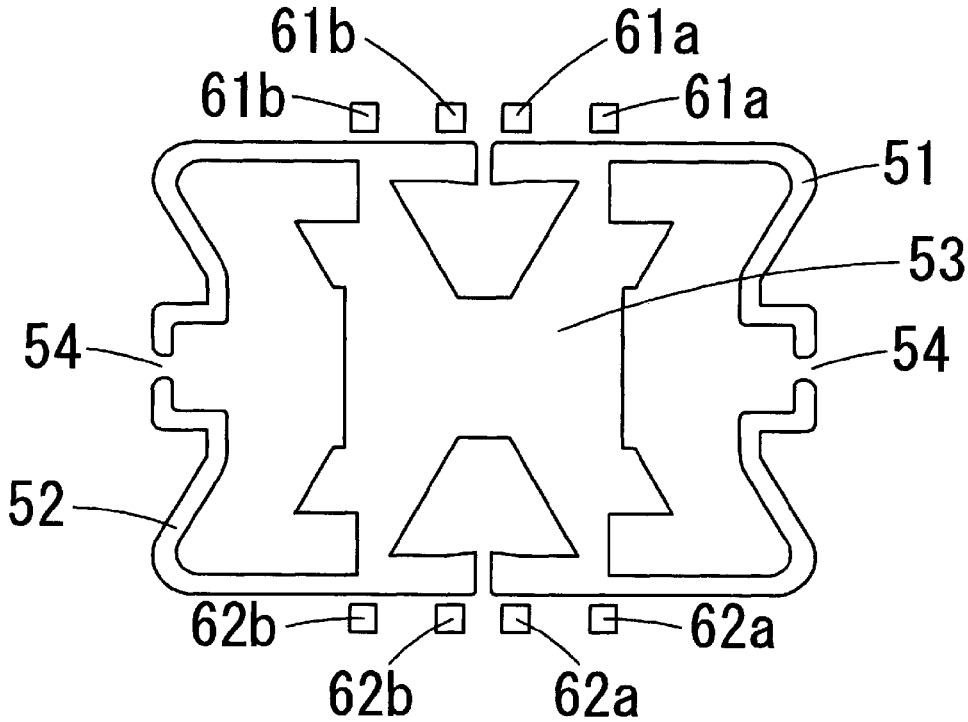
FIG. 13 is a sectional view taken along a line I-I in FIG. 8 as viewed in the direction denoted by the arrows.
Figure 14:
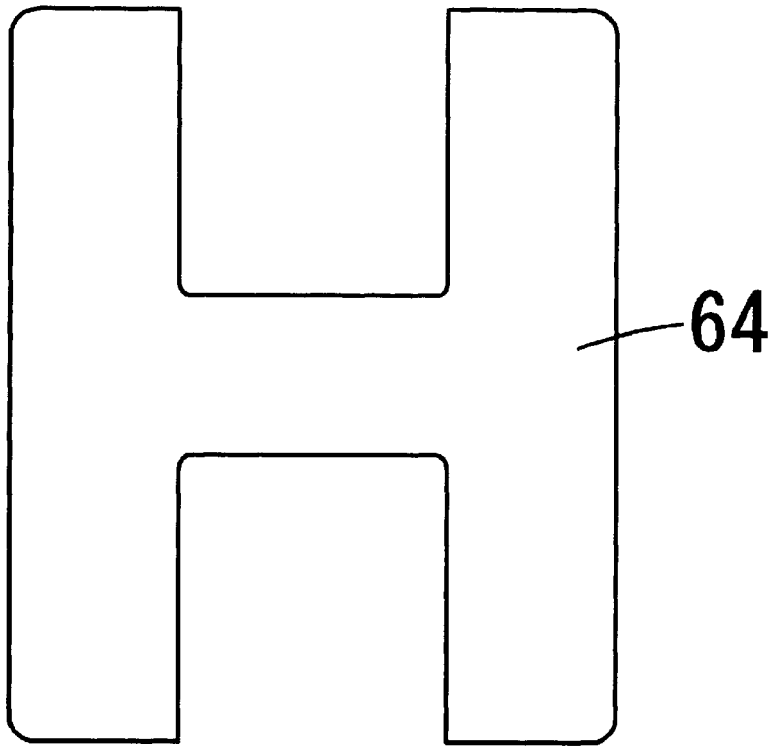
FIG. 14 is a sectional view taken along a line J-J in FIG. 8 as viewed in the direction denoted by the arrows.

As illustrated in FIG. 8, the slider 40 is constituted by a slider body 50 through which the elements 30 are moved for meshing and unmeshing, and a pull 60 used for moving the slider body 50. As illustrated in sectional views (FIGS. 9 to 14) representing respectively cross-sections of the slider body 50 taken along linear lines E to J in FIG. 8, the slider body 50 is made up of an upper vertical case 51 and a lower vertical case 52 (FIG. 9), which are coupled to each other by a coupling portion 53 for coupling both the cases (FIG. 13). A horizontal slit 54 through which the horizontal fastener tape 33 is inserted is formed between the upper vertical case 51 and the lower vertical case 52, and vertical slits 55 through which the upper vertical fastener tape 37 and the lower vertical fastener tape 39 are inserted, respectively, are formed at the middles of the upper vertical case 51 and the lower vertical case 52.

An element passage 56 is formed inside the slider body 50, and the plural elements 30 arranged in a line along each of the oppositely-positioned edges of the opening/closing ends of the fastener tapes 20 are inserted through the element passage 56. The element passage 56 allows the insertion of the meshed elements 30 therethrough on the side corresponding to the linear line E (FIG. 9), and further allows the insertion of the unmeshed elements 30 therethrough, which are in the state separated to the left and the right by the coupling portion 53, on the side corresponding to the linear line I (FIG. 13). Upper pull attachment portions 57*a* and 57*b* are vertically provided on the upper vertical case 51 at both sides of the vertical slit 55 (FIGS. 8 and 10 to 12). Similarly, lower pull attachment portions 58*a* and 58*b* are vertically provided on the lower vertical case 52 at both sides of the vertical slit 55 (FIGS. 8 and 10 to 12).

As illustrated in FIGS. 8 and 12 to 14, the pull 60 is made up of upper attachment portions 61*a* and 61*b* and lower attachment portions 62*a* and 62*b* for attachment to the slider body 50, and a thumb 64. The upper attachment portions 61*a* and 61*b* are attached respectively to the upper pull attachment portions 57*a* and 57*b* of the upper vertical case 51 of the slider body 50, and the lower attachment portions 62*a* and 62*b* are attached to the lower pull attachment portions 58*a* and 58*b* of the lower vertical case 52 of the slider body 50 in opposing relation from the upper and lower sides of the slider body 50. In such a structure, the pull 60 is pulled to slide the slider 40 in the direction denoted by the arrow X (FIG. 2) and is pushed to slide the slider 40 in the direction reversed to that denoted by the arrow X (FIG. 2).

The operation of the slide fastener 10 constituted by the elements 30, each having the above-described specific shape, and the slider 40 will be described below. When the pull 60 is pulled to slide the slider 40 in the direction denoted by the arrow X, as illustrated in FIGS. 1 and 2, along the plural elements 30 that are arranged in a line along each of the edges of the horizontal fastener tapes 33, the heads 32 of the elements 30 are out of mesh from each other at the position (corresponding to FIG. 6) denoted by the line D-D, but they are moved to gradually come closer to each other as represented by the position (corresponding to FIG. 5) denoted by the line C-C and the position (corresponding to FIG. 4) denoted by the line B-B. Finally, the heads 36*a* are meshed with each other at the position (corresponding to FIG. 3) denoted by the line A-A, whereby the horizontal fastener tapes 33 are closed in the horizontal direction.

Figure 15:
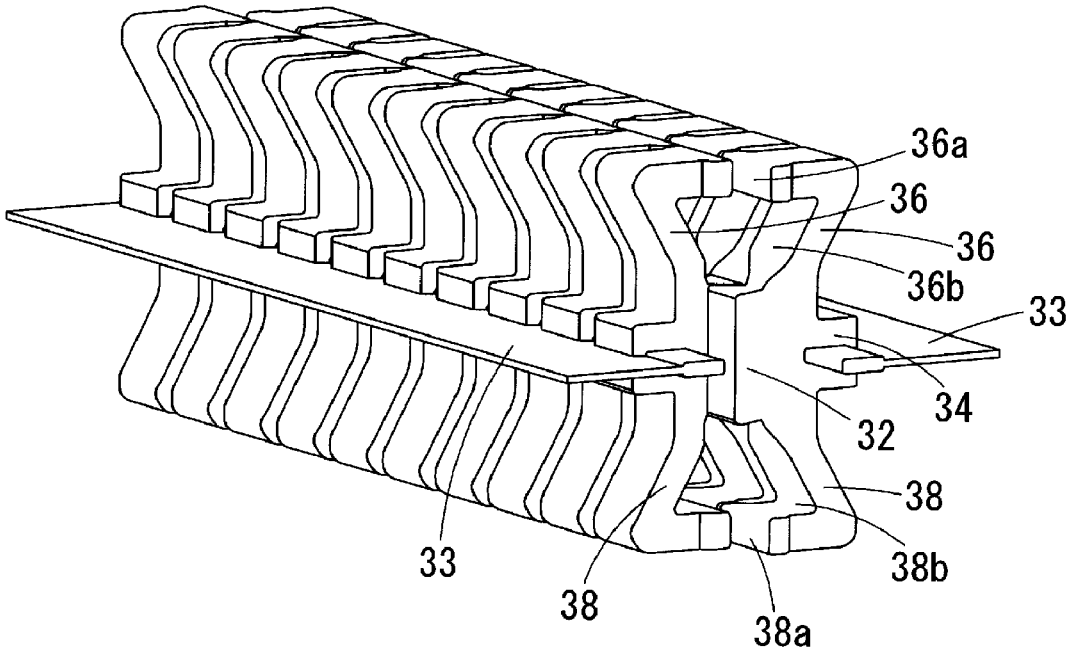
FIG. 15 is an explanatory view to explain an operation that upper legs of the elements and lower legs of the elements come close to each other with meshing of element heads in a horizontal functional section.
Figure 16:
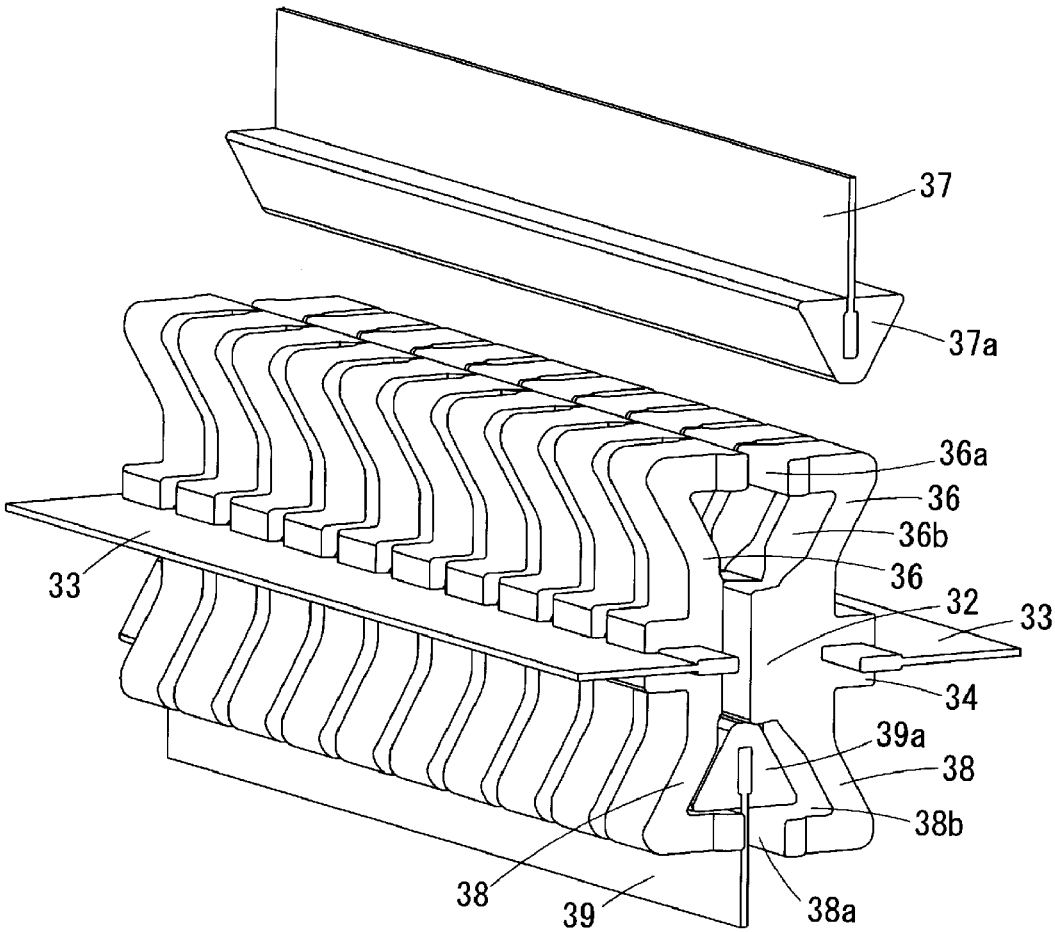
FIG. 16 is an explanatory view to explain an operation that an upper vertical fastener tape and a lower vertical fastener tape are engaged in upper holding portions and lower holding portions, which are formed by the upper element legs and the lower element legs coming close to each other on the upper and lower sides, respectively.

When the heads 32 of the elements 30 are meshed with each other, the distal ends 36*a* of the upper element legs 36 extending upwards perpendicularly to the horizontal functional section 31 come closer to each other, as illustrated in FIGS. 3 to 6, 15 and 16, in conjunction with the meshing of the element heads 32 (FIG. 15). Because the upper element legs 36 are bent into the hook-like shape, the upper holding portions 36*b* are formed by the distal ends 36*a* of the upper element legs 36, which are positioned close to each other (FIG. 15). When the upper holding portions 36*b* are formed, the upper vertical fastener-tape fixed portion 37*a* to which the upper vertical fastener tape 37 is fixed is engaged in the upper holding portions 36*b* (FIG. 16).

Similarly, when the distal ends 38*a* of the lower element legs 38 extending downwards perpendicularly to the horizontal functional section 31 come closer to each other in conjunction with the meshing of the element heads 32, the lower holding portions 38*b* are formed (FIG. 15). Thus, the lower vertical fastener-tape fixed portion 39*a* to which the lower vertical fastener tape 39 is fixed is engaged in the lower holding portions 38*b* (FIG. 16).

Further, when the pull 60 is pushed to slide the slider 40 in the direction reversed to that denoted by the arrow X (FIG. 2), the heads 32 of the elements 30 meshed with each other at the position (corresponding to FIG. 3) denoted by the line A-A are successively unmeshed as represented by the position (corresponding to FIG. 4) denoted by the line B-B, the position (corresponding to FIG. 5) denoted by the line C-C, and the position (corresponding to FIG. 6) denoted by the line D-D. In conjunction with the successive unmeshing of the heads 32, the distal ends 36*a* of the upper element legs 36 and the distal ends 38*a* of the lower element legs 38 are moved respectively farther away from each other such that the upper holding portions 36*b* and the lower holding portions 38*b* are not formed in an enclosed state. Therefore, the upper vertical fastener-tape fixed portion 37*a* to which the upper vertical fastener tape 37 is fixed and the lower vertical fastener-tape fixed portion 39*a* to which the lower vertical fastener tape 39 is fixed are not engaged respectively in the upper holding portions 36*b* and the lower holding portions 38*b*.

As described above, by creating and employing the fastener element having above-described shape, the slide fastener includes the horizontal functional section for dividing one space into two spaces and the vertical functional section for further dividing each of the two spaces, divided by the horizontal functional section, into two spaces with one operation using one slider. It is therefore possible to provide the slide fastener which can divide one space into four spaces, which are orthogonal to one another, with one operation using one slider.

Accordingly, when the slide fastener is applied to partitioning of the inside of a temporarily installed tent with the horizontal functional section and the vertical functional section both oriented to extend in the up-and-down direction, one living space formed inside the temporarily installed tent can be divided into four independent spaces with one operation using one slider.

The invention claimed is:

1. A slide fastener, comprising:

two horizontal fastener tapes, elements which are arranged in a line along oppositely-positioned edges of opening/closing ends of the two horizontal fastener tapes, each of the elements comprising a horizontal section having an element head on a first horizontal side of the horizontal section and a fastener-tape fixed portion on a second horizontal side of the horizontal section, the fastener-tape fixed portion being attached to one of the two horizontal fastener tapes, an upper element leg extending upwards from the element head in the vertical direction and being bent into a hook shape, a lower element leg extending downwards from the element head in the vertical direction and being bent into a hook shape, an upper vertical fastener tape having an upper vertical fastener-tape fixed portion attached thereto, a lower vertical fastener tape having a lower vertical fastener-tape fixed portion attached thereto, a slider in which the elements are arranged to oppositely face each other and in which the element heads of the elements are meshed with each other by sliding the slider along the oppositely-faced elements, whereby distal ends of the upper element legs of the oppositely-faced elements form an upper holding portion and distal ends of the lower element legs of the oppositely-faced elements form a lower holding portion, wherein the upper vertical fastener-tape fixed portion of the upper vertical fastener tape is engageable in the upper holding portion, and wherein the lower vertical fastener-tape fixed portion of the lower vertical fastener tape is engageable in the lower holding portion.

* * * * *